US005305223A

United States Patent [19]

Saegusa

[11] Patent Number: 5,305,223

[45] Date of Patent: Apr. 19, 1994

[54] TUBE BENDING MACHINE

[75] Inventor: Shigeru Saegusa, Sunto, Japan

[73] Assignee: Usui Kokusai Sangyo Kaisha Ltd., Japan

[21] Appl. No.: 577,890

[22] Filed: Sep. 5, 1990

[30] Foreign Application Priority Data

Sep. 7, 1989 [JP] Japan ..... 1-232550

[51] Int. Cl.[5] ..... B21D 7/04

[52] U.S. Cl. ..... 364/472; 364/474.07; 72/10; 72/14; 72/31; 72/149

[58] Field of Search ..... 364/472, 474.07; 72/6-10, 14, 15, 21-23, 30-33, 149, 150

[56] References Cited

U.S. PATENT DOCUMENTS 2,810,422 10/1957 Bower .
3,205,690 9/1965 Roessler .
3,553,989 1/1971 Munro et al. .
4,380,917 4/1983 Uchida et al. .
4,412,438 11/1983 Tjushevsky et al. ..... 72/10
4,625,531 12/1986 Lafrasse et al. .
4,719,577 1/1988 Eley ..... 364/474.07
4,732,025 3/1988 Marlinga et al. .
4,959,984 10/1990 Trudell et al. .
4,979,385 12/1990 LaFrasse et al. ..... 72/10
5,007,264 4/1991 Haack ..... 72/10
5,050,089 9/1991 Stelson et al. ..... 364/474.07

*Primary Examiner*—Jerry Smith
*Assistant Examiner*—Thomas E. Brown
*Attorney, Agent, or Firm*—Anthony J. Casella; Gerald E. Hespos

[57] ABSTRACT

A tube bending machine in which a tube detecting sensor detects an amount of bending a tube during the bending process and a controlling unit performs control so that the amount of bending detected by the sensor becomes a value corresponding to the program stored in a memory beforehand; thus, the second and subsequent tubes are bent accurately and efficiently by a drive command from the memory.

10 Claims, 15 Drawing Sheets

TUBE BENDING MACHINE

BACKGROUND OF THE INVENTION

1. Field of the Invention

This invention relates to a tube bending machine, and more particularly, to a tube bending machine performing a bending work by applying pushing or tensile force to a tube to be bent.

2. Description of the Prior Art

The bending of a metallic tube holds an important position in the industry such as the vehicle or automobile manufacturing industry. Namely, tubes installed in a vehicle are required to be bent lengthwise accurately at their predetermined positions in order to route them while avoiding other parts or to connect them to other parts.

In the prior art, wherein a tube is bent for these purposes, the tube is bent as established beforehand with a gripping means which grips, moves, and sets the tube at a predetermined position and with die means which bend the tube at the predetermined position by a prescribed amount, and after the bending work is completed, the dimensions of the bent tube are measured with a three-dimensional measuring apparatus, wherein if correction is required, adjustments are made in the subsequent bending process with regard to the amount of movement and setting df the gripping means as well as the bending amount of the die means.

In the Japanese Laid-Open Patent Application No. 63-290624, a tube bending method and a tube bending machine have been proposed wherein a position sensing means detects a prescribed position between one end of the tube and the bending position after the tube is bent as established beforehand with a gripping means which grips, moves, and sets the tube at the prescribed position and with die means which perform the bending work at the bending position by a prescribed amount of bending.

In the method proposed by the said Application, the position sensing means detects a position after the tube is bent, and a control means modifies the bending amount of the die means so that the detected position comes to be the preset value and the predetermined bending work can be realized.

In the aforesaid conventional method, since the bending amount is adjusted by measuring the bent tube dimensions with the three-dimensional measuring apparatus after a first tube is bent, this tube cannot be used as a product in many cases. In the case of comparatively short tubes, it is possible to use them as a product, but in the case of long tubes, the bending amount is required to be readjusted each time the bending work is performed since the work is affected by differences in hardness, elastic limit, and yield force due to variance in the material, wall thickness, and heat treatment conditions of the tubes. Furthermore, in the case of small-diameter tubes, correct dimensional measurements may not be possible since deflection occurs with such a tube when measured with the three-dimensional measuring apparatus. On the other hand, in the method proposed by the Japanese Laid-Open Patent Application No. 63-290624, it becomes practically difficult to apply the method to long tubes because the position sensing means must be made very large in size, while with small-diameter tubes, deflection increases at areas closer to the tube end after the bending work is performed, so that high-accuracy position sensing is no longer possible.

SUMMARY OF THE INVENTION

The present invention has been made in view of the aforesaid status of tube bending. Therefore, it is an object of the present invention to provide a tube bending machine capable of performing a prescribed bending work accurately and efficiently by detecting the amount of tube bending with a sensor during the bending process and by controlling the value detected by the sensor so that it becomes a value corresponding to what has been programmed beforehand in the memory.

In order to achieve said object, the first aspect of the present invention is so constructed that in the tube bending machine consisting of a memory wherein a tube bending program is stored, a gripping device which grips said tube at the rear end and moves the tube in the axial direction and around the axis according to the program read from said memory, and a bending die and a pushing die device which bend the tube at the predetermined position by a prescribed amount, there are provided a sensor which is installed on the pushing die device and detects the amount of bending and a controlling unit which controls the value detected by the sensor so that it is brought close to the value based on the program stored in said memory.

The second aspect of the present invention is so constructed that in the tube bending machine consisting of a memory in which a tube bending program is stored, a gripping device which grips the tube at the rear end and moves the tube in the axial direction and around the axis according to the program read from said memory, and tube bending devices which bend the tube at the predetermined position by a prescribed amount, there are provided a bending die which is rotatable around a pivot shaft in contact with the peripheral surface of the tube, a pushing die device which is rotatable around said pivot shaft while holding the tube together with said bending die, a sensor which is installed on the pushing die device and detects the amount of tube bending, and a controlling unit which causes the pushing die device to be set according to said program, the bending die to move around the pivot shaft, the tube to be bent so that the bending amount detected by said sensor is brought close to a preset value, and the pushing die device to be reset after the bending work is completed.

In the so-called "push bending" according to the first aspect of the present invention, the amount of bending of the tube by the die device is detected by the sensor and the value so detected is controlled by the controlling unit so that it is brought close to the value based on the program stored beforehand in the memory.

In the so-called "tension bending" according to the second aspect of the present invention, the bending die and the pushing die device hold the tube between and revolve around the same pivot shaft with the tube held firmly, thus the tube is bent by the applied tensile force. In this case, the amount of bending of the bent tube detected by the sensor installed on the pushing die device is controlled by the controlling unit so that it is brought close to the preset value stored in the memory.

DETAILED DESCRIPTION OF THE PREFERRED EMBODIMENTS

Figure 1:
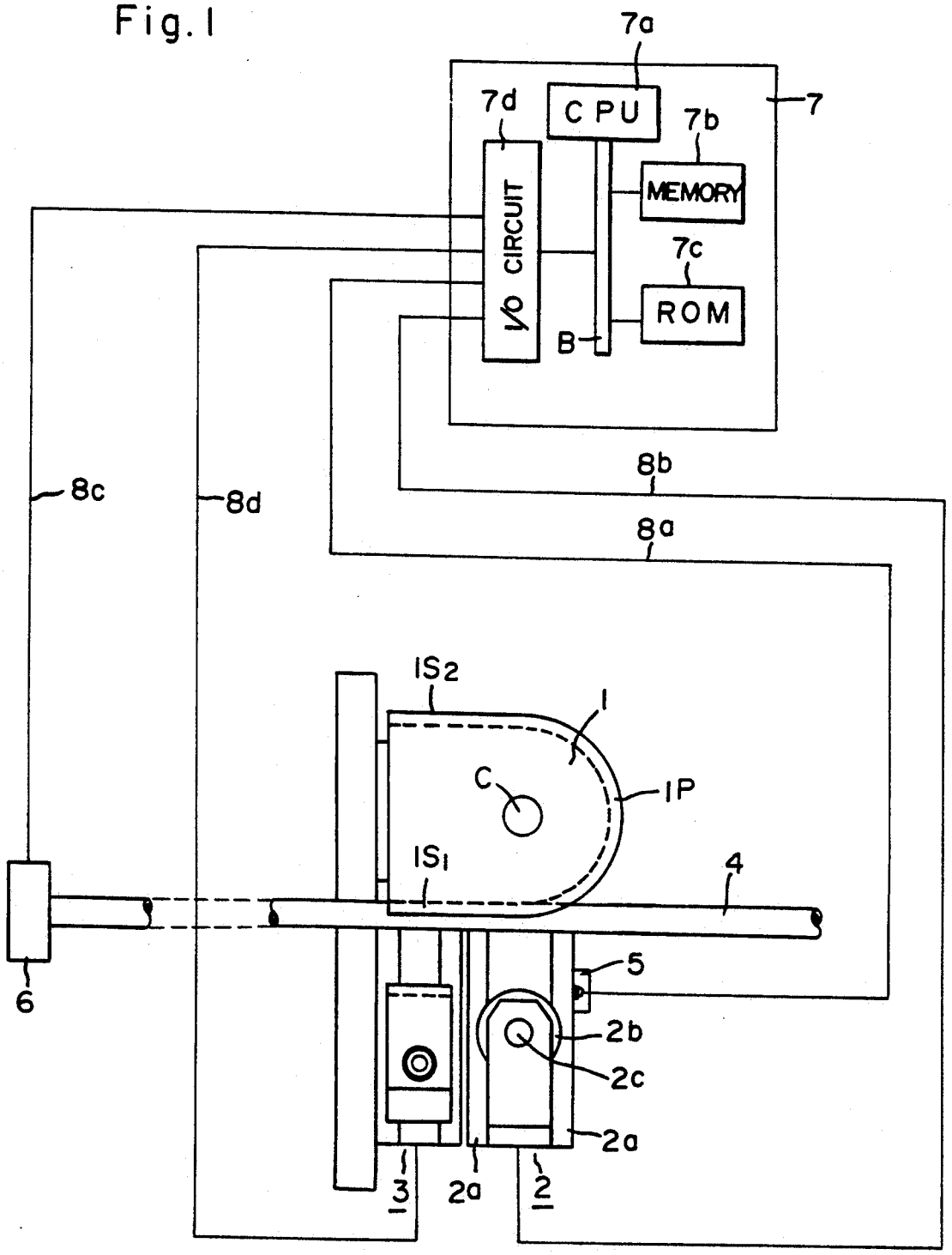
FIG. 1 is a diagram showing the configuration of the first embodiment of the present invention.

In each of the drawings, the same reference number is used for the same member. The embodiment shown in FIGS. 1 through 3 is the so-called "push bending" machine to which the present invention is applied. FIG. 1 is a diagram illustrating the configuration of the first embodiment, wherein the pushing die 2 and the clamp section 3 are disposed facing the fixed bending die 1 with a shaping surface 1P having a given value of curvature. On the bending die 1, straight guide surfaces 1S1 and 1S2 are formed in parallel with each other in continuity with the shaping surface 1P. The sectional contour of the said shaping surface 1P and the straight guide surfaces 1S1 and 1S2 is the same as part of the section of the tube 4 disposed in contact with and facing the straight guide surface 1S1, and since the tube 4 used in this embodiment is columnar, the sectional contour of the shaping surface 1P and the straight guide surfaces 1S1 and 1S2 are semicircular.

On the pushing die 2, guides 2*a*'s are provided in parallel with each other, and along the guides 2*a*'s, a movable roll 2*b* for holding the tube is provided in such a manner as to permit the roll 2*b* to revolve around a pivot shaft 2*c*. On one of the guides 2*a*'s, a tube detecting sensor of photoelectric type is fitted, and the whole pushing die 2 is rotatable around the pivot c of the bending die 1.

The clamp section 3 is movable perpendicularly to the straight guide surface 1S1 to clamp the tube 4 and release the clamp.

A gripping device 6 that grips and moves the tube 4 in the axial direction and around the axis is provided in the vicinity of the rear end of the tube 4 introduced in contact with the straight guide surface 1S1.

A controlling unit 7 is provided in the embodiment. This controlling unit 7 is equipped with a CPU 7*a*, a memory 7*b*, a ROM 7*c*, and an I/O circuit 7*d*. The I/O circuit 7*d*, the memory 7*b* and the ROM 7*c* are connected to the CPU 7*a* via a bus B. Said tube detection sensor 5, the pushing die 2, the gripping device 6, and the clamp section 3 are connected to the I/O circuit 7*d* with signal lines 8*a* through 8*d*, respectively.

In the memory 7*b* of the controlling unit 7*a* there has been inputted beforehand a program for bending the tube 4, that is data on variance in the material, outside diameter, wall thickness, and heat treatment conditions of the tube 4; the multiple positions and the order of the axial movement of the tube 4 by the gripping device 6; the angles of gyration by the gripping device 6 around the axis at each of the movement positions; and the angles of bending of the tube 4 with the bending die 1 and the pushing die 2 at each of the movement positions.

Command signals for driving the gripping device 6, the pushing die 2 and the clamp section 3 are inputted from the I/O circuit 7*d* to the gripping device 6, the pushing die 2 and the clamp section 3 via the signal lines 8*c*, 8*b*, and 8*d*. The detection signal from the tube detection sensor 5 is inputted to the I/O circuit 7*d* via the signal line 8*a*.

Operations in the so-called "push bending" embodiment shown in FIG. 1 are explained below. In this embodiment, when a start button (not shown) is depressed, the CPU 7*a* reads the program for bending the tube 4 from the memory 7*b*, whereby a drive command signal is inputted via the I/O circuit 7*d* and the signal line 8*c* to the gripping device 6, which grips the tube to be bent at the rear end portion, moves it in the axial direction to the first command position, rotates the tube 4 around the axis by the commanded angle at said position, and stops with the tube kept gripped.

In this way, when the tube 4 is moved and stopped at the first bending position, the bending work at this position is performed.

Figure 2A:
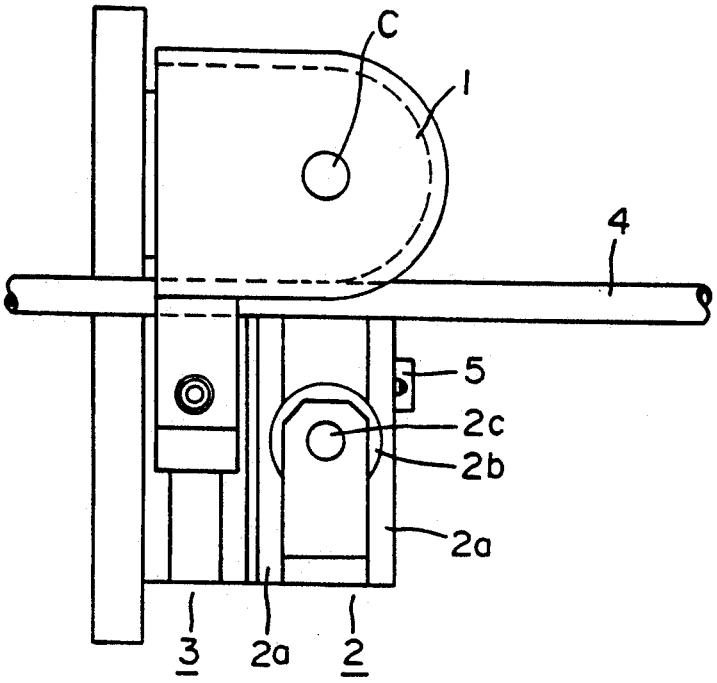
FIGS. 2*a* through 2*g* are diagrams showing each of the bending processes of the first embodiment.
Figure 2B:
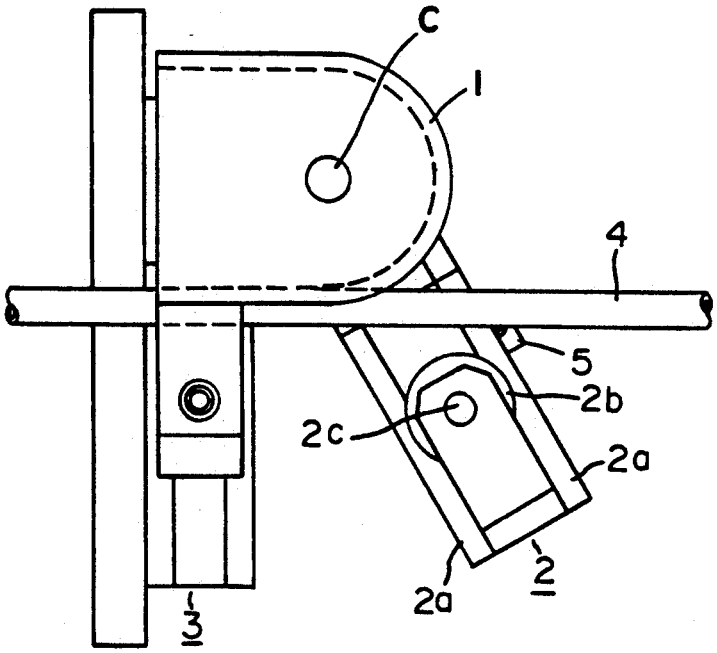
Figure 2C:
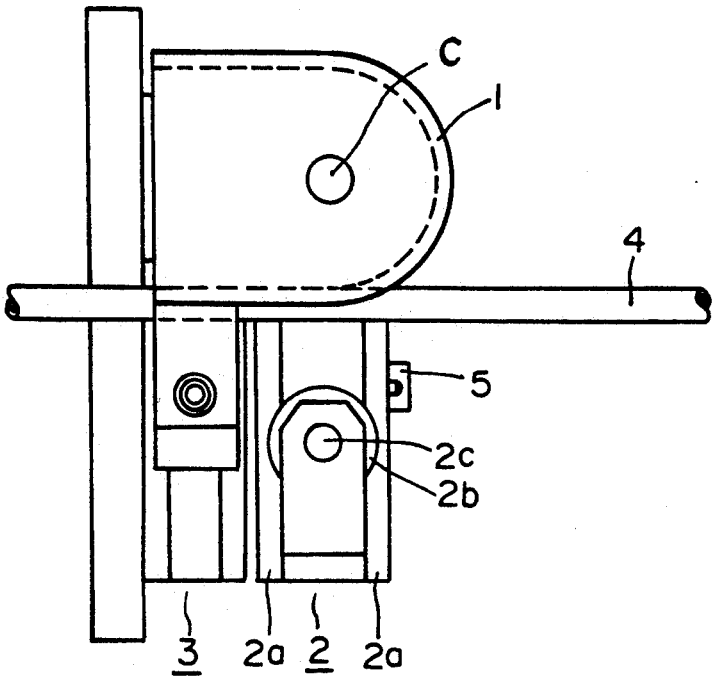
Figure 2D:
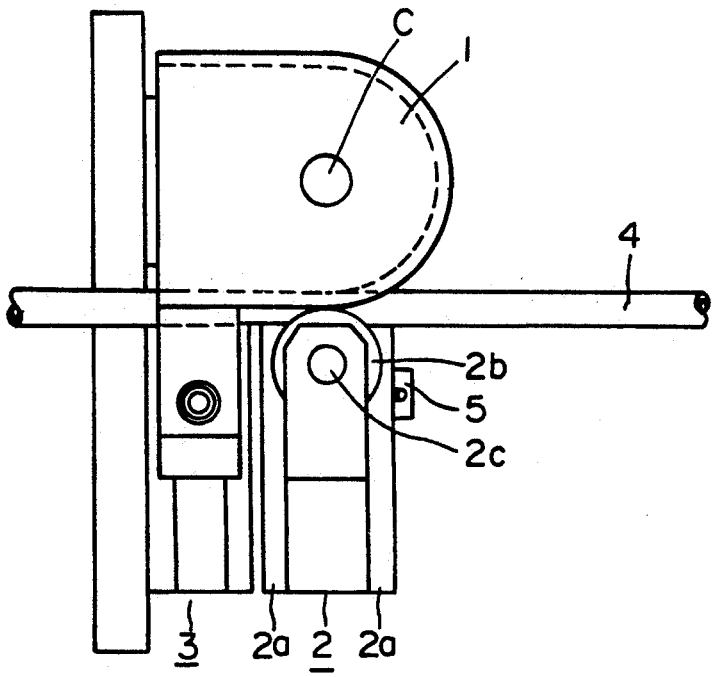
Figure 2E:
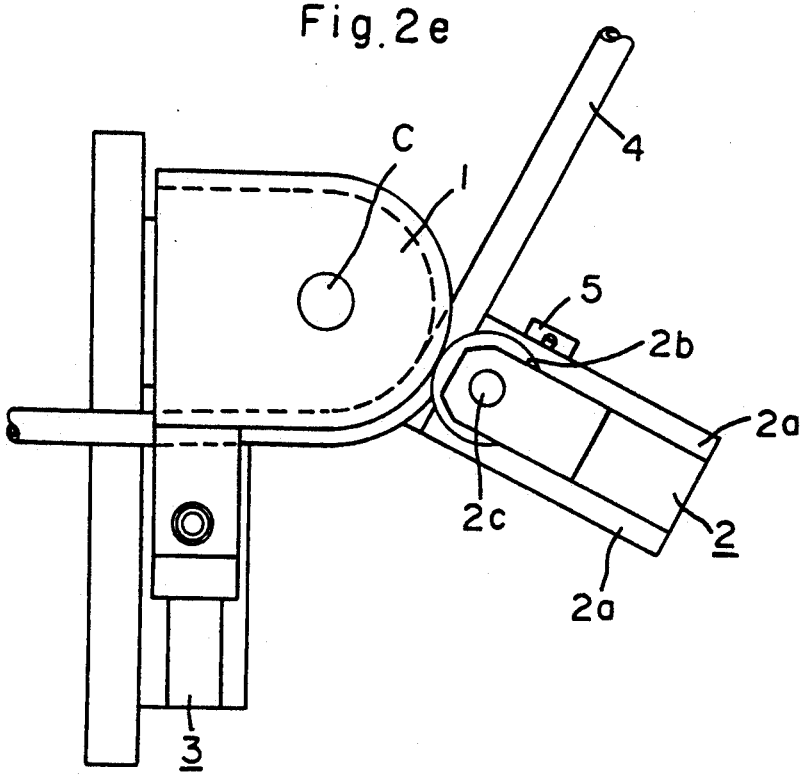
Figure 2F:
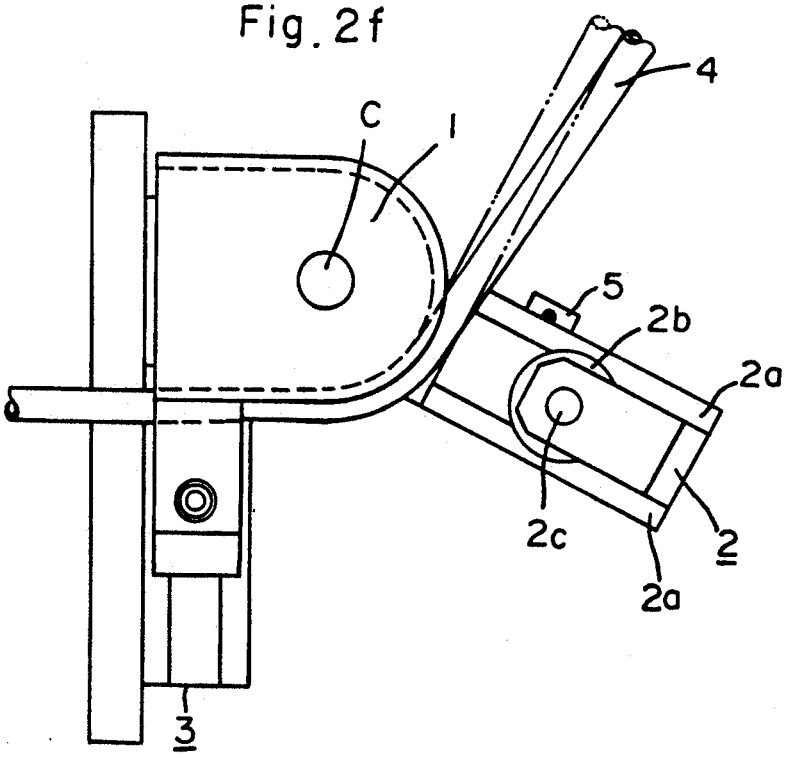
Figure 2G:
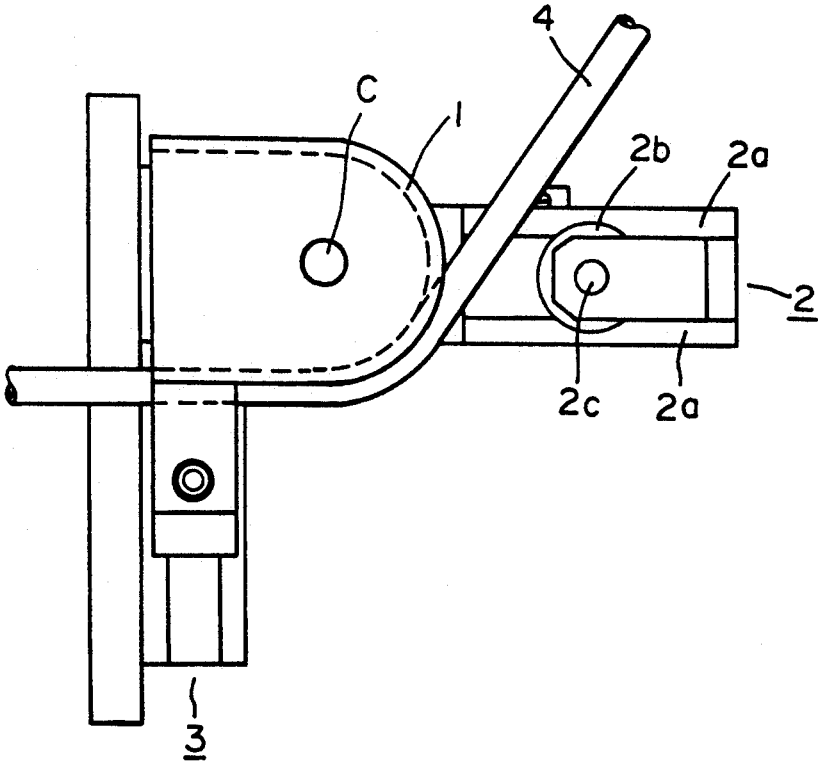
Figure 3A:
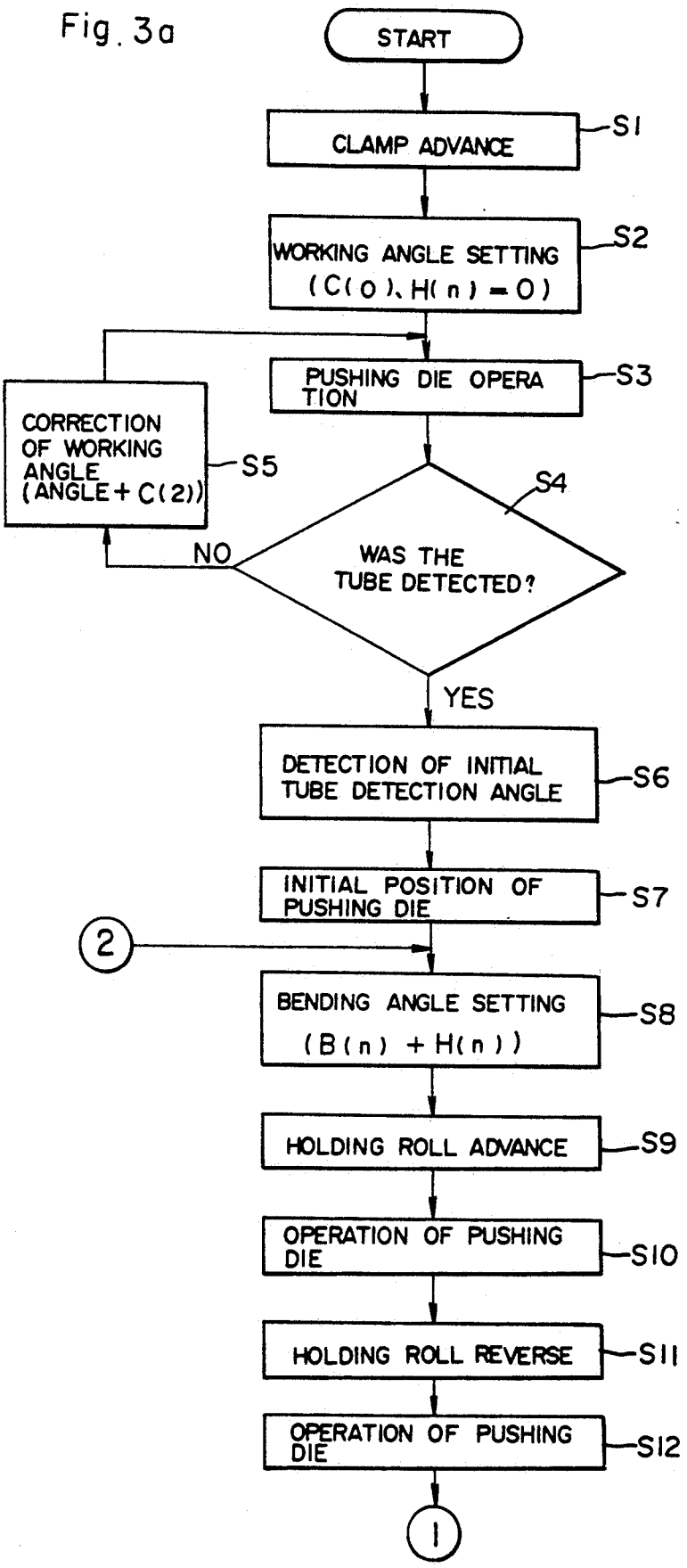
FIGS. 3*a* and 3*b* are the parts of a flowchart showing the bending works of the first embodiment.
Figure 3B:
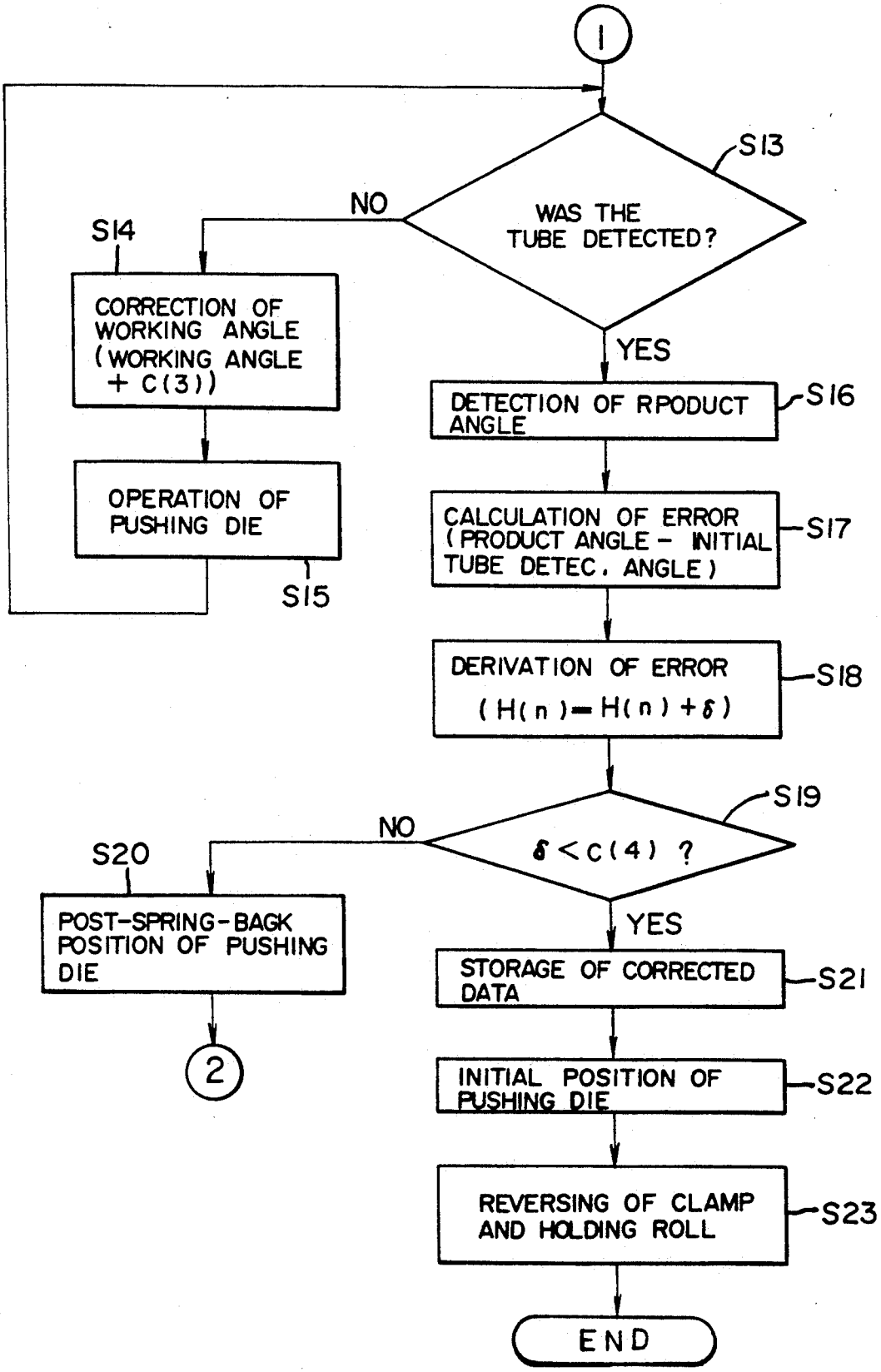

FIGS. 2*a* through 2*g* are diagrams showing each of the "push bending" processes of the first embodiment, and FIGS. 3*a* and 3*b* are the parts of a flowchart illustrating the bending processes of this embodiment.

As described above, when the tube 4 to be bent is moved, stopped, and held at the bending position, a command signal is inputted from the controlling unit 7 to the clamp section 3 via the signal line 8*d* in Step S1, whereupon the clamp device advances in the clamp section 3 as shown in FIG. 2*a*, and clamps the tube 4. In Step S2, the working angle for the pushing die 2 is read from the memory 7*b* and set up, and in Step 3, the pushing die 2 revolves around the pivot shaft c by the set working angle.

In Step 4, it is judged whether or not the tube 4 to be bent is detected by the tube detecting sensor 5. If the judgment is negative, a correction value C(2) is added to the working angle set in Step 2, and the pushing die 2 revolves by this new working angle as shown in FIG. 2*b*.

When the judgment in Step S4 is affirmative, the process advances to Step 6, where the initial tube detection angle is detected, and in Step S7, the pushing die 2 returns to the initial position as shown in FIG. 2*c*.

Then, in Step S8, the theoretical bending angle B(n) is read out from the memory 7*b*, and a correction value H(n) is added to this theoretical bending angle B(n), whereby the corrected bending angle is set. The initial position of this corrected value must not exceed the return angle that arises as a result of the spring back of the tube 4 as described below. In Step S9, the tube holding roll 2*b* of the pushing die 2 advances and comes in contact with the tube 4 as shown in FIG. 2*d*. In Step S10, the pushing die 2 revolves around the pivot shaft c and the tube 4 is bent by the pushing die 2 and the bending die 1 as shown in FIG. 2*e*.

In Step S11, after the bending process, the tube holding roll 2*b* of the pushing die 2 moves back as shown in FIG. 2*f*, whereupon the bent tube slightly returns from the position shown by the alternate long and two short dash line to the continuous line as shown in the figure, by the spring back. In Step S12, the pushing die 2 revolves around the pivot shaft c by the preset angle of rotation. Then, in Step S13, judgment is made on whether or not the tube 4 is detected by the tube detection sensor 5 as in the case of Step S4 described above. If the judgment is negative, a correction value C(3) is added to the working angle in Step S14, and in Step S15, the pushing die 2 turns by the new working angle until the tube detection sensor 5 detects the tube 4.

When the judgment in Step S13 is affirmative, the angle of the bent tube detected is measured in Step S16, and the bending angle is calculated by deducting the initial tube angle detected in Step S6 from the angle of the bent tube in Step S17. The calculated angle of bending is compared with the standard bending angle read by the CPU 7*a* from the memory 7*b* and any discrepancy between the standard bending angle and the calculated bending angle for the bent tube is computed in Step S18.

In Step S19, judgment is made on whether or not this error is smaller than the standard permissible error, and if the judgment is negative, the pushing die 2 returns to the initial position in Step S20 and the operations from Step S8 on are repeated. When the judgment in Step S19 is affirmative, the corrected data is stored in the memory 7*b* of the controlling unit 7 in Step S21 and the data is used as a correction value in the subsequent bending operations. Then, the pushing die 2 returns to the initial position in Step S22, and the clamp in the clamp section 3 and the tube holding roll 2*b* of the pushing die 2 move back in Step S23.

In this way, the bending work on the tube 4 at the first predetermined position is completed, whereupon the gripping device 6 is actuated to transfer the tube to the next prescribed position according to the program stored in the memory 7*b*, where the subsequent bending work is performed according to the program stored in the memory.

The subsequent tube bending works are performed in a similar way by the gripping device 6 and the pushing die 2 actuated under the control of the controlling unit 7 according to the program stored in the memory 7*b*. Namely, the second and subsequent tubes are bent by the drive command from the memory 7*b* without angle detection by the tube detection sensor 5.

According to this embodiment, the effects produced on bending accuracy by differences in the hardness, elastic limit, and yield force due to wear of the bending die 1, the pushing die 2, and the holding roll 2, the set positions of the bending die 1 and the pushing die 2, and variance in the hardness, wall thickness, and heat treatment conditions of the tube 4 to be bent, are all completely set off during the bending process by detecting the bending angle with the tube detecting sensor 5, and by controlling so that the detected angle corresponds to the standard value, under which conditions the bending work is performed with a high precision.

Figure 4:
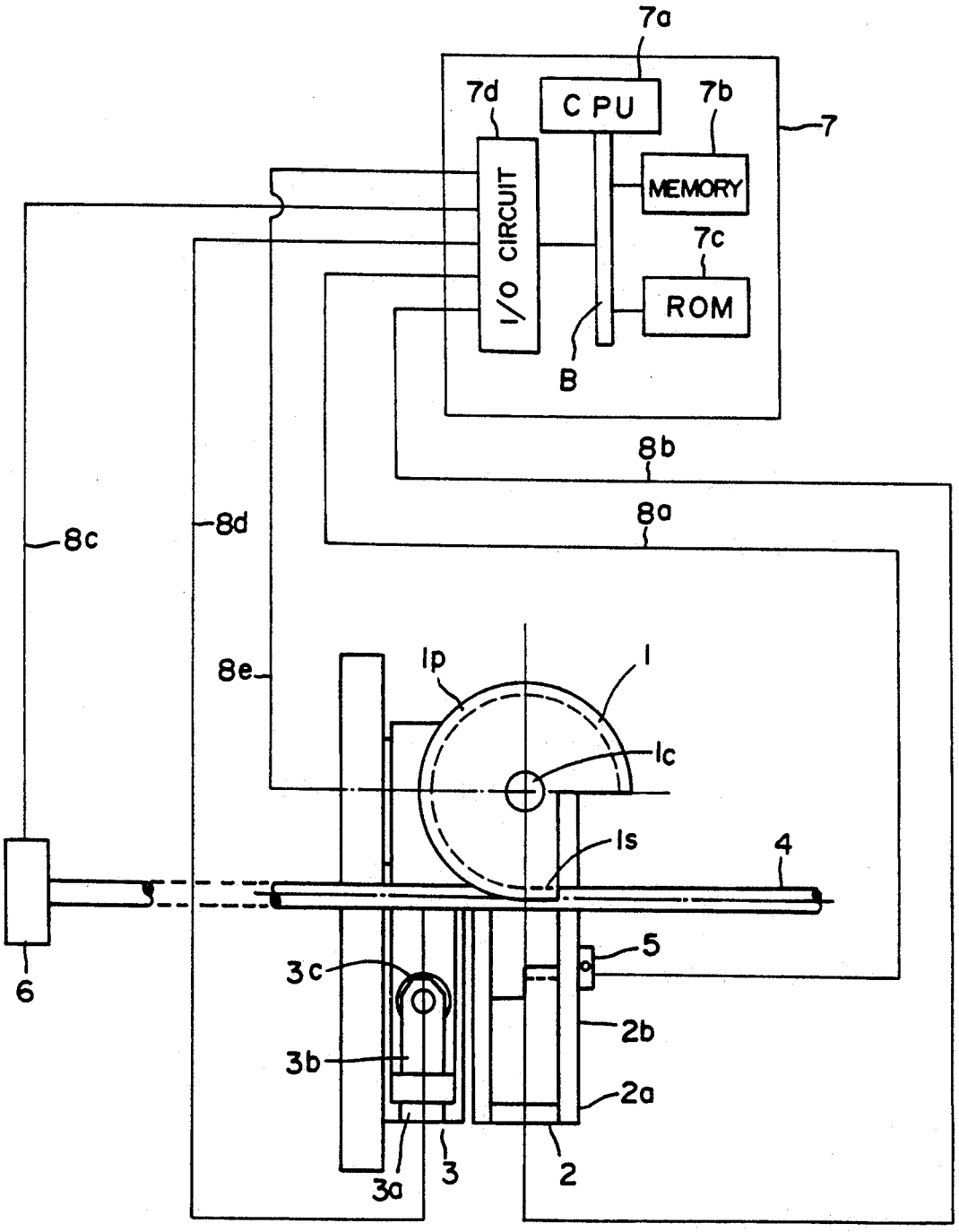
FIGS. 4 is diagram showing the configuration of the second embodiment of the present invention.

The following describes the embodiment showing the so-called "tension bending" in FIGS. 4 through 7. FIG. 4 is a diagram showing the second embodiment of the present invention, where a pushing die device 2' and a counterforce bearing member 3' are disposed facing a bending die 1' having a shaping surface 1P with a given value of curvature. On the bending die 1', a straight guide surface 1S is formed in continuity with the shaping surface 1P. The sectional contour of the shaping surface 1P and the straight guide surface 1S is the same as part of the section of the tube 4 to be bent. Since tubes used in this embodiment are columnar as in the case of the first embodiment, the sectional contour of the shaping surface 1P and the straight guide surface 1S is semicircular. The bending die 1' is so constructed that it is movable around the pivot shaft 1*c*.

A pushing die 2'*b* movable perpendicularly to the said straight guide surface 1S along both sides of the base frame 2'*a* is provided on the pushing die device 2'. On one side of the base frame 2'*a*, a tube detecting sensor of photoelectric type is installed, and the whole base frame 2'*a* is movable around the pivot shaft 1*c*.

The counterforce bearing member 3' consists of a base frame 3'*a*, a counterforce bearer 3'*b* movable perpendicularly to the straight guide surface 1S on the base frame 3'*a*, and a counterforce bearing roller 3'*c* provided on the end of the counterforce bearer, the counterforce bearing roller 3'*c* being so constructed that it engages or disengages with the tube 4 introduced in contact with the straight guide surface 1S .

The gripping device 6 and the controlling unit 7 used in this embodiment have a substantially similar construction to that of the first embodiment. However, in this second embodiment, the tube detecting sensor 5, the pushing die device 2', the gripping device 6, the counterforce bearing member 3', and the bending die 1' are connected together to the I/O circuit 7*d* via signal lines 8*a* through 8*e*.

Furthermore, command signals by which the gripping device 6, the pushing die 2'*b*, the counterforce bearing member 3', and the bending die 1' are actuated are inputted from the I/O circuit 7*d* to the gripping device 6, the pushing die 2'*b*, the counterforce bearing member 3', and the bending die 1' via the signal lines 8*c*, 8*b*, 8*d*, and 8*e*, respectively. Detection signals from the tube detection sensor 5 are inputted to the I/O circuit 7*d* via the signal line 8*a*.

The following describes operations in the so-called "tension bending" embodiment shown in FIG. 4. Like the first embodiment illustrated in FIG. 1, the bending work is performed on the tube gripped, transferred, and stopped at the first working position by the gripping device 6.

Figure 5A:
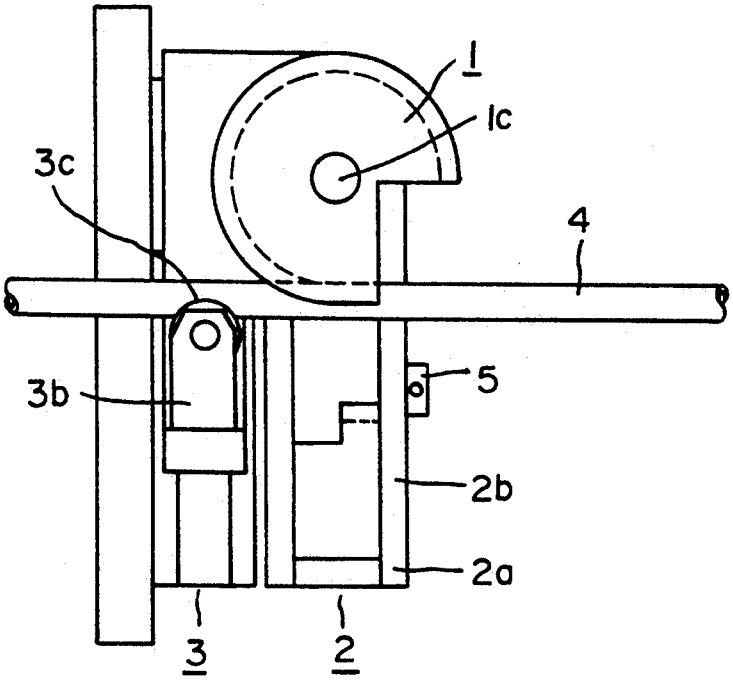
FIGS. 5*a* through 5*g* are diagrams showing each of the bending processes of the second embodiment.
Figure 6A:
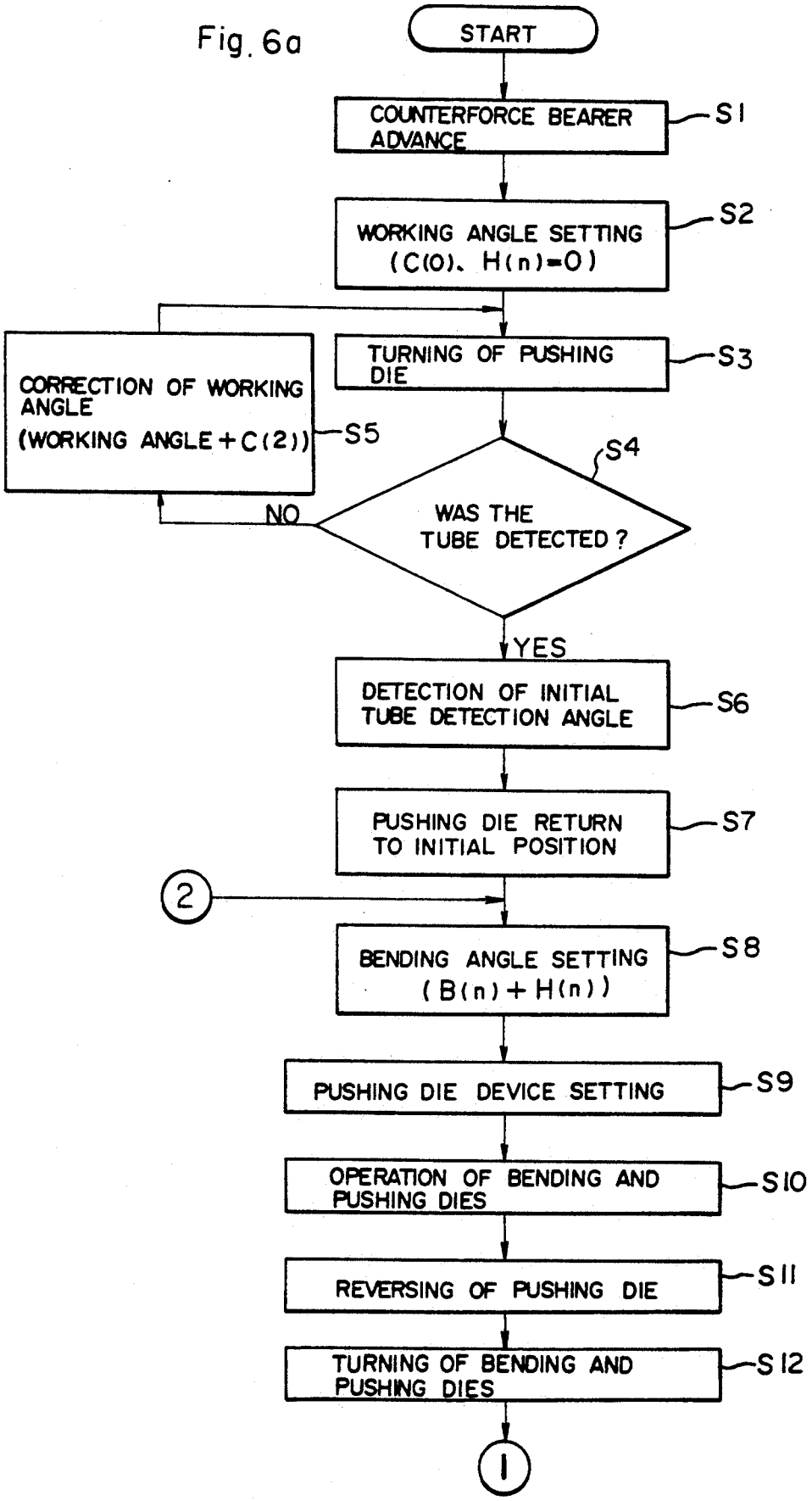
FIGS. 6*a* and 6*b* are the parts of a flowchart showing the bending works of the second embodiment.
Figure 6B:
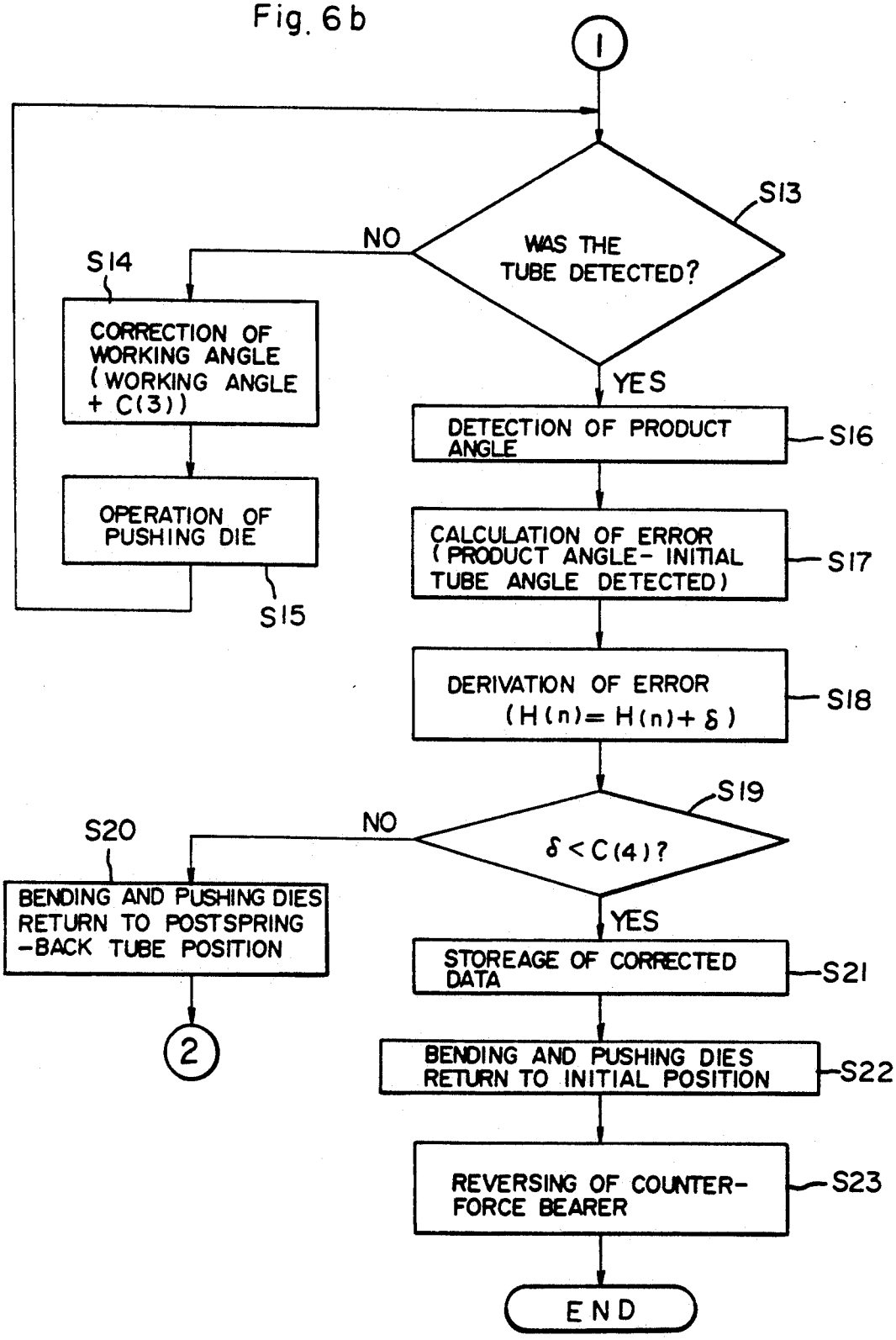

FIGS. 5*a* though 5*g* are diagrams showing of the bending work of the second embodiment, and FIGS. 6*a* and 6*b* are the parts of a flowchart showing the bending processes of the embodiment.

As described above, when a tube 4 to be bent is transferred, stopped, and held at the working position, a command signal is inputted to the counterforce bearing member 3' from the controlling unit 7 via the signal line 8*d* in Step S1, whereupon the counterforce bearer 3'*b* of the counterforce bearing member 3' advances as shown in FIG. 5*a* and the counterforce bearing roller 3'*c* fits on the tube 4 and holds it. In Step S2, the working angle for the pushing die 2'*b* is read out from the memory 7*b* and set. In Step S3, the pushing die 2'*b* turns around the pivot shaft 1*c* by the set working angle.

Figure 5B:
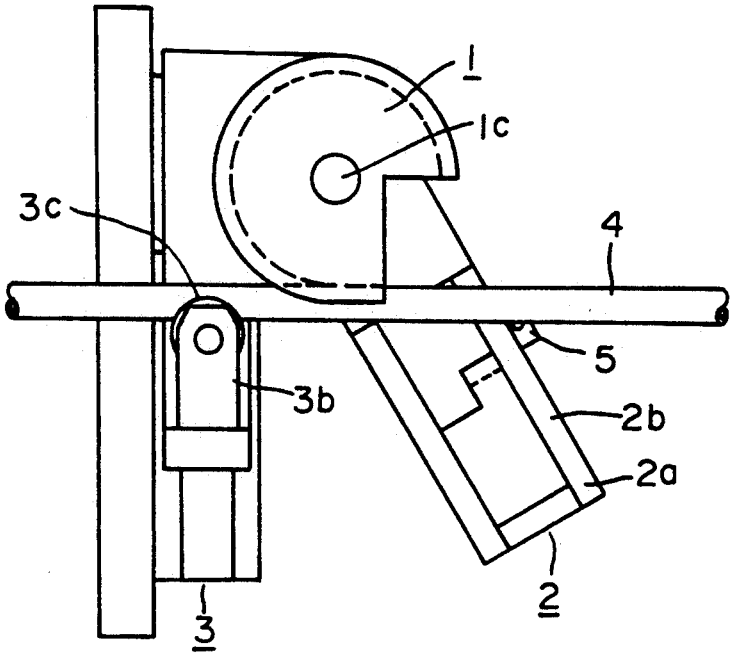

In Step S4, judgment is made on whether or not the tube 4 is detected by the tube detecting sensor 5. If the judgment is negative, a correction value C(2) is added in Step S5 to the working angle set in Step S2, and the pushing die 2' turns by the new working angle as shown in FIG. 5*b*.

Figure 5C:
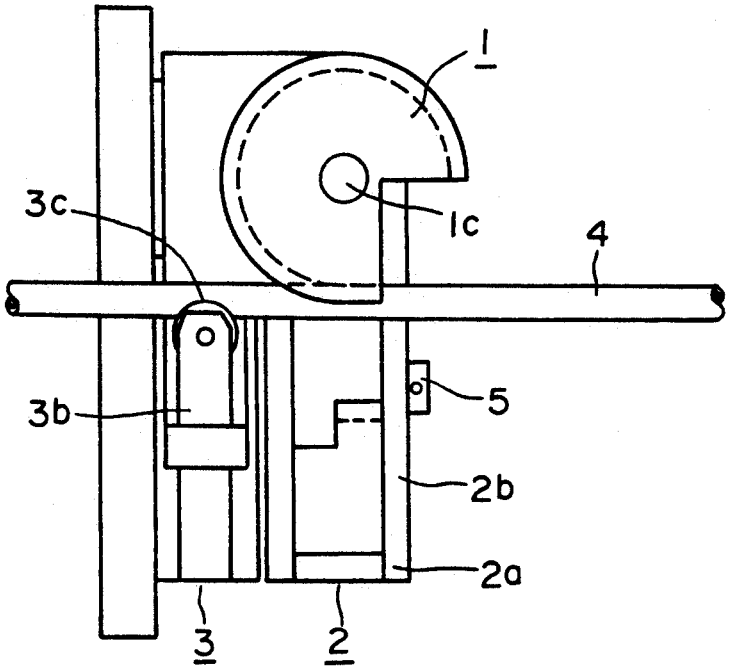
Figure 5D:
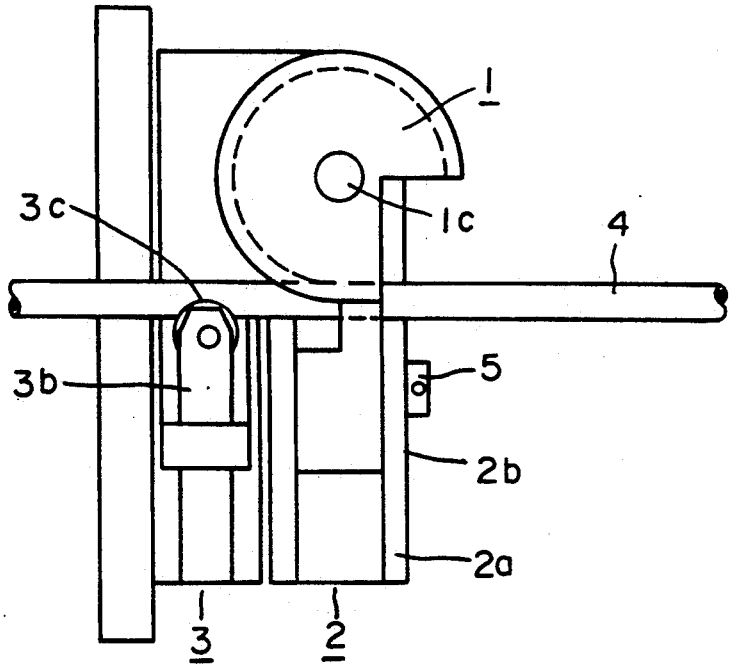
Figure 5E:
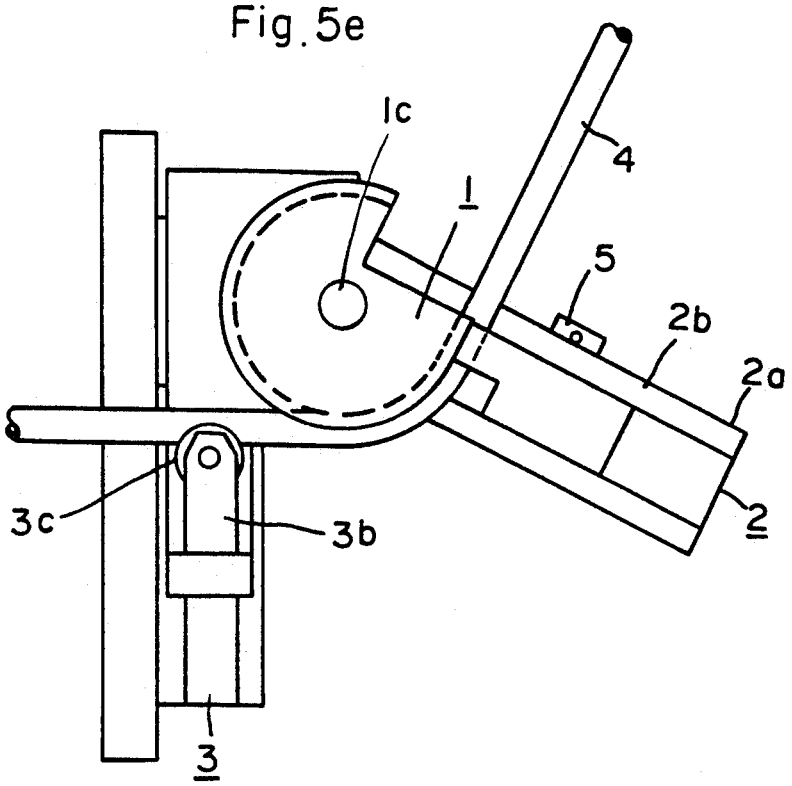

When the judgment in Step S4 is affirmative, the initial detection angle of the tube 4 is detected in Step S6, and the pushing die 2'*b* returns to the initial position in Step S7 as shown in FIG. 5*c*. Then, in Step S8, the theoretical bending angle B(n) for the pertinent process is read out from the memory 7, and a correction value H(n) is added to this theoretical bending angle B(n), whereby the corrected bending angle is set. The initial position of this corrected value must not exceed the return angle that arises as a result of the spring back of the tube 4 as described below. In Step S9, the pushing die 2'*b* of the pushing die device 2' advances and holds the tube 4 as shown in FIG. 5*d*. In Step S10, the bending die 1' and the pushing die device 2' revolve around the pivot shaft 1c, and the tube 4 is bent by the pushing die 2'b and the bending die 1' as shown in FIG. 5e.

Figure 5F:
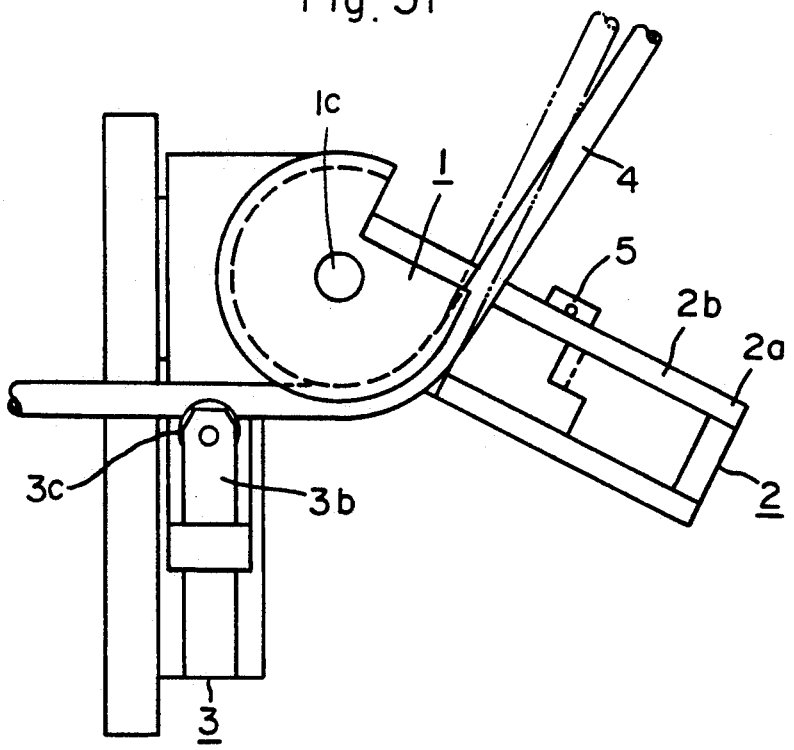

In Step S11, after the bending process, the pushing die 2'b of the pushing die device 2' moves back and down as shown in FIG. 5f, when the bent tube slightly returns from the position shown by the alternate long and two short dash line to the continuous line by the spring back as shown.

Figure 5G:
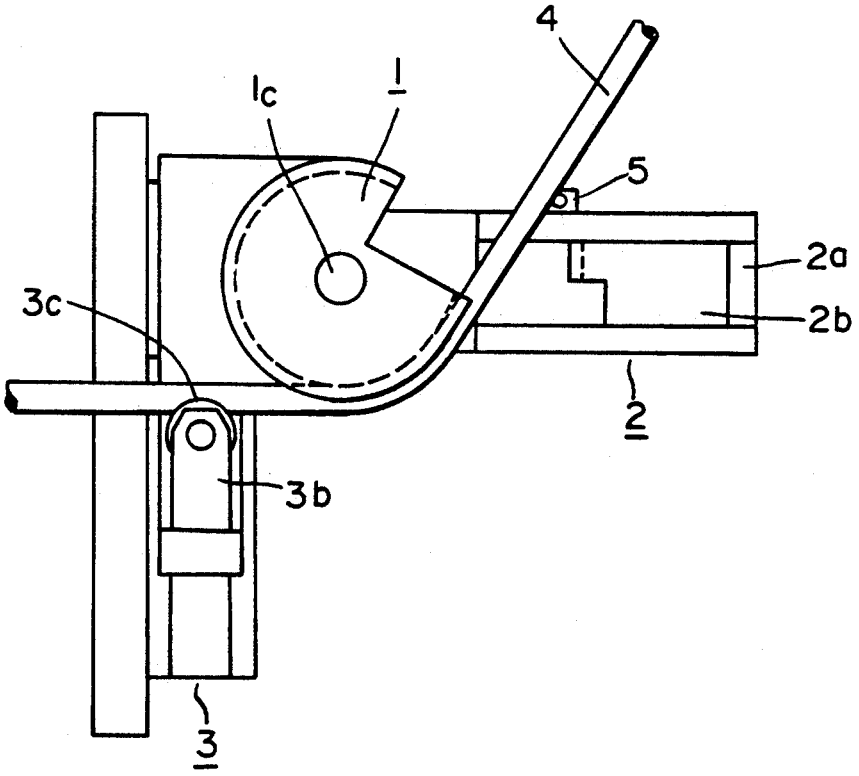
Figure 7:
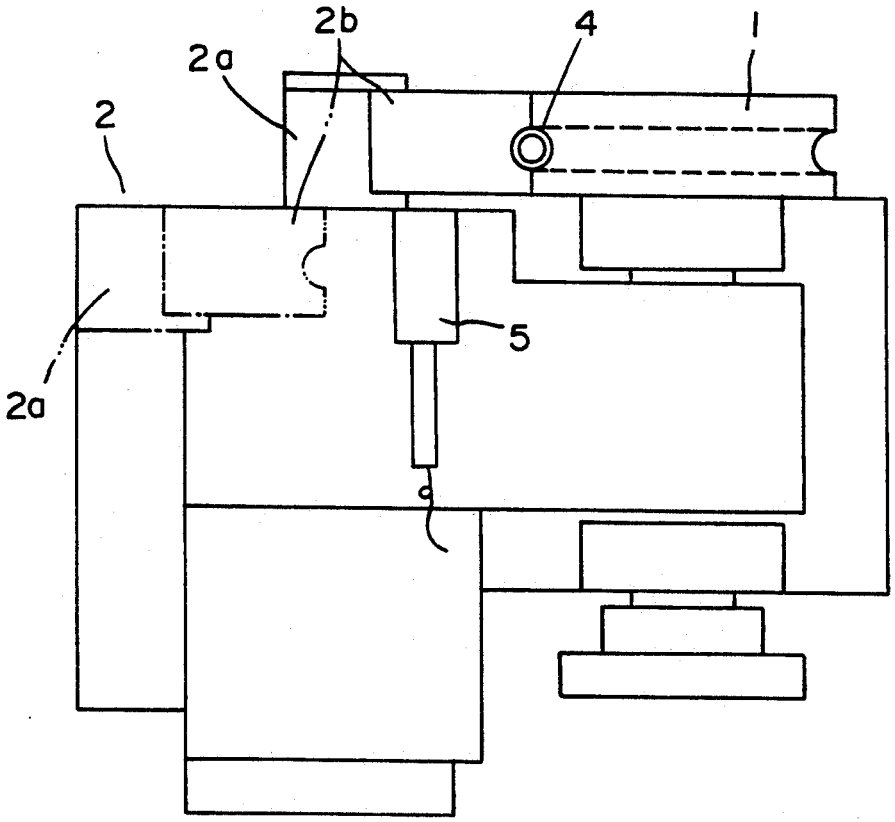
FIGS. 7 is a diagram showing the resetting of the pushing die device in the second embodiment of the present invention.

FIG. 7 is a diagram showing the moving back and down of the pushing die 2'b in Step S11, wherein the pushing die 2'b is caused to move back diagonally from the continuous line position to the alternate long and two short dash line position in FIG. 7 and then to go down by a link drive mechanism (not shown) after the bending process is completed. Then, in Step S12, the pushing die device 2' turns around the pivot shaft 1c by the set working angle as shown in FIG. 5g. In Step S13, judgment is made as in the case of Step S4 described above on whether or not the tube 4 is detected by the tube detecting sensor 5. If the judgment is negative, a correction value C(3) is added to the working angle in Step S14, and in Step S15, the bending die 1' and the pushing die device 2' turn by this new working angle until the tube detection sensor 5 detects the tube 4.

When the judgment in Step S13 is affirmative, the angle of the tube after bending is measured in Step S16, and the bending angle is calculated by deducting the initial tube angle detected in Step S6 from the angle of the bent tube in Step S17. In Step S18, the calculated angle of bending is compared with the standard bending angle read out by the CPU 7a from the memory 7b and any discrepancy between the standard bending angle and the calculated bending angle for the bent tube is computed.

In Step S19, judgment is made on whether or not this error is smaller than the standard permissible error, and if the judgment is negative, the bending die 1' and the pushing die device 2' return in Step S20 to the detected angle position, that is the position of the tube after the spring back, and the operations from Step S8 are repeated. When the judgment in Step S19 is affirmative, the corrected data is stored in the memory 7b of the controlling unit 7 in Step S21, and the data is used as a correction value in the subsequent bending operations.

In Step S22, the bending die 1' and the pushing die device 2' return to the initial position. Then, in Step S23, the counterforce bearer 3'b of the counterforce bearing member 3' moves back to separate the counterforce bearing roller 3'c from the tube 4.

In this way, the bending work on the tube 4 at the first predetermined position is completed, whereupon the gripping device 6 is actuated to transfer the tube 4 to the next prescribed position according to the program stored in the memory 7b, where the subsequent bending work is performed according to the program stored in the memory 7b.

The subsequent tube bending works are performed in a similar way by the gripping device 6 and the pushing die device 2' actuated under the control of the controlling unit 7 according to the program stored in the memory 7b. Namely, the second and subsequent tubes are bent by the drive command from the memory 7b without angle detection by the tube detecting sensor 5.

The effects produced on bending accuracy by differences in the hardness, elastic limit, and yield force due to wear of the bending die 1', pushing die device 2', pushing die 2'b and the counterforce bearing roller 3'c, the setting positions of the bending die 1', the pushing die device 2' and the counterforce bearer 3'b, and variance in the material, outside diameter, wall thickness, and heat treatment conditions of the tube 4, are all completely set off during the bending process by detecting the bending angle by the tube detecting sensor 5 and by controlling so that the detected angle corresponds to the standard value, under which conditions the bending work is performed with a high accuracy just as in the first embodiment described above.

In either embodiment of the present invention, the cases where the photoelectric type sensor is used as a sensor for detecting the tube have been explained. However, the present invention is not limited to these embodiments. A sensor in which a switch such as a proximity or limit switch is built, a light screen type sensor, or a vibration detecting sensor may be used.

As described in details above, since control is performed by the controlling unit based on the value detected by the tube detecting sensor in the present invention, correction is made during the bending process so that the bending angle is brought close to the standard value despite not only the effects of differences in the hardness, elastic limit, and yield force due to variance in the material, outside diameter, wall thickness, and heat treatment conditions of the tube, but also the effect of machine precision, wear of the bending members, and the set positions, thus permitting continuous high-precision bending to be performed efficiently.

What is claimed is:

1. A tube bending machine having a memory wherein a program for bending a tube is stored, a gripping device which grips said tube at an end and selectively moves the tube in the axial direction of the tube and around the axis of the tube according to the program read out from said memory, and tube bending devices which bends the tube by a prescribed amount at a predetermined position on said tube, said machine comprising:

a bending die having a peripheral surface in contact with said tube, a pushing die device capable of turning around a pivot shaft and capable of moving toward and away from the bending die and the tube in contact with the bending die, such that movement of the pushing die device toward the bending die engages the tube and such that the turning o the pushing die device around the pivot shaft is operative for bending said tube along the peripheral surface of said bending die, a photoelectric sensor which is installed on said pushing die device and detects said tube when the pushing die device is turned around the pivot shaft a sufficient amount for alignment of the photoelectric sensor with the tube, and a controlling unit to cause said pushing die device to be set according to said program, to be turned around said pivot shaft, ad to bend said tube so that the position of said tube detected by said sensor is brought close to a given value, whereby the pushing die device is turned around the pivot shaft with the pushing die device away from the tube such that the photoelectric sensor can detect the position of the tube, and whereby the controlling unit compares the detected position of the tube with the given value and determines whether additional bending by the pushing die device is required.

2. A tube bending machine according to claim 1, wherein the bending die is stationary and has a given value of curvature on at lest part of its peripheral surface, and the pushing die device has a frame and a holding roll capable of moving relative to said frame so as to coming in contact with said tube.

3. A tube bending machine according to claim 2, wherein a clamp section is provided, said clamp section being capable of moving perpendicularly to a straight guide surface provided on the peripheral surface of said bending die to clamp said tube by facing said straight guide surface and to release the clamp.

4. A tube bending machine according to claim 1, wherein said bending die is capable of moving around the shaft and has a given value of curvature on at least part of its peripheral surface, the pushing die device is capable of moving with the bending die around said pivot shaft while holding said tube against the peripheral surface of said bending die.

5. A tube bending machine according to claim 4, wherein said pushing die device is capable of moving radially away from the pivot shaft and moving downwardly generally parallel to the shaft after the bending work is completed.

6. A tube bending machine according to claim 4, wherein a counterforce bearing section is provided, said bearing section being capable of moving perpendicularly to a straight guide surface provided on the peripheral surface of said bending die.

7. A tube bending machine according to claim 1, wherein said controlling unit comprises a CPU, a memory, a ROM, and an I/O circuit, and said I/O circuit, memory, and ROM are connected to the CPU via a bus.

8. A tube bending machine according to claim 1, wherein the pushing die device comprises a frame tunable about the pivot shaft and a pushing die movable on the frame toward and away from the pivot shaft for selectively engaging and disengaging the tube against the bending die, the photoelectric sensor being mounted to the frame.

9. A tube bending machine having a memory in which a program for bending a tube is stored, a gripping device which grips said tube at an end and moves the tube in the axial direction of the tube ad around the axis of the tube according to the program read out from said memory, a bending die having a curved peripheral surface about which the tube can be bent and a pushing die device which can be turned around a pivot shaft to bend said tube by a prescribed amount around the bending die at a predetermined position on the tube according to the program read out from said memory, at lest a portion of the pushing die device being selectively movable toward and away from the bending die for selectively engaging and disengaging the tube therebetween, sad tube bending machine comprising:

a photoelectric sensor which is installed on said pushing die device and detects the tube when the pushing die device is turned sufficiently around the pivot shaft for the photoelectric sensor to align with said tube, ad a controlling unit which compares the position of the tube detected by said photoelectric sensor to the prescribed amount read out from said memory and, if necessary, operates the pushing die device again to perform additional bending so that the bend int he tube is brought close to the prescribed amount based on the program stored in said memory.

10. A tube bending machine having a memory in which a program for bending a tube is stored, a gripping device which grips said tube at an end and moves the tube in the axial direction of the tube and around the axis of the tube according to the program read out from said memory, a bending device which bends said tube by a prescribed amount at a predetermined position, said tube bending machine comprising:

a bending die which comes in contact with said tube and is capable of moving around a pivot shaft, a pushing die device which is moved to and set at a start position where the pushing die device holds said tube together with said bending die, said pushing die device being capable of moving around said pivot shaft from the start position while holding said tube against the peripheral surface of said bending die, a photoelectric sensor which is installed on the pushing die device and detects the tube when the pushing die device is turned sufficiently around the pivot shaft for the photoelectric sensor to align with said tube, and a controlling unit which compares the detected position of the tube to a given value and causes said tube to be bent so that the position detected by said photoelectric sensor is brought close to the given value and thereafter causes said tube to be released.

* * * * *